US006431076B1

(12) United States Patent
O'Dwyer

(10) Patent No.: US 6,431,076 B1
(45) Date of Patent: Aug. 13, 2002

(54) FIREARMS

(75) Inventor: James Michael O'Dwyer, Brisbane (AU)

(73) Assignee: Metal Storm Limited, Brisbane (AU)

( * ) Notice: Subject to any disclaimer, the term of this patent is extended or adjusted under 35 U.S.C. 154(b) by 0 days.

(21) Appl. No.: 09/424,970

(22) PCT Filed: Jun. 2, 1998

(86) PCT No.: PCT/AU98/00414

§ 371 (c)(1),
(2), (4) Date: Dec. 3, 1999

(87) PCT Pub. No.: WO98/55825

PCT Pub. Date: Dec. 10, 1998

(30) Foreign Application Priority Data

Jun. 3, 1997 (AU) ..... PO7158

(51) Int. Cl.[7] ..... F42B 14/02; F41A 19/00; F41A 19/64

(52) U.S. Cl. ..... 102/525; 42/84; 89/1.3; 102/432; 102/438; 102/524; 102/526

(58) Field of Search ..... 102/345, 352, 102/360, 430, 431, 432, 438, 520, 524–527; 42/51, 84; 89/1.3

(56) References Cited

U.S. PATENT DOCUMENTS 2,313,030 A * 3/1943 Tauschek ..... 42/84
3,169,333 A * 2/1965 Scanlon, Jr. ..... 42/84
5,883,329 A 3/1999 O'Dwyer

FOREIGN PATENT DOCUMENTS

WO WO 97/20809 9/1994
WO WO 97/04281 2/1997

* cited by examiner

*Primary Examiner*—Harold J. Tudor
(74) *Attorney, Agent, or Firm*—Oblon, Spivak, McClelland, Maier & Neustadt, P.C.

(57) ABSTRACT

A method of minimising misfiring or alleviating their consequences is provided by forming at least each trailing projectile (30) in a series of housed projectiles with a sealing portion (34) extending about a tapered anvil portion (31) and moveable therealong for expansion into sealing engagement with the barrel (11). The sealing portion (34) disengages forwardly in response to a misfire or the like to provide a bleed path for igniting the propellant charge (41) associated with the next leading projectile (30).

10 Claims, 3 Drawing Sheets

Figure 1:
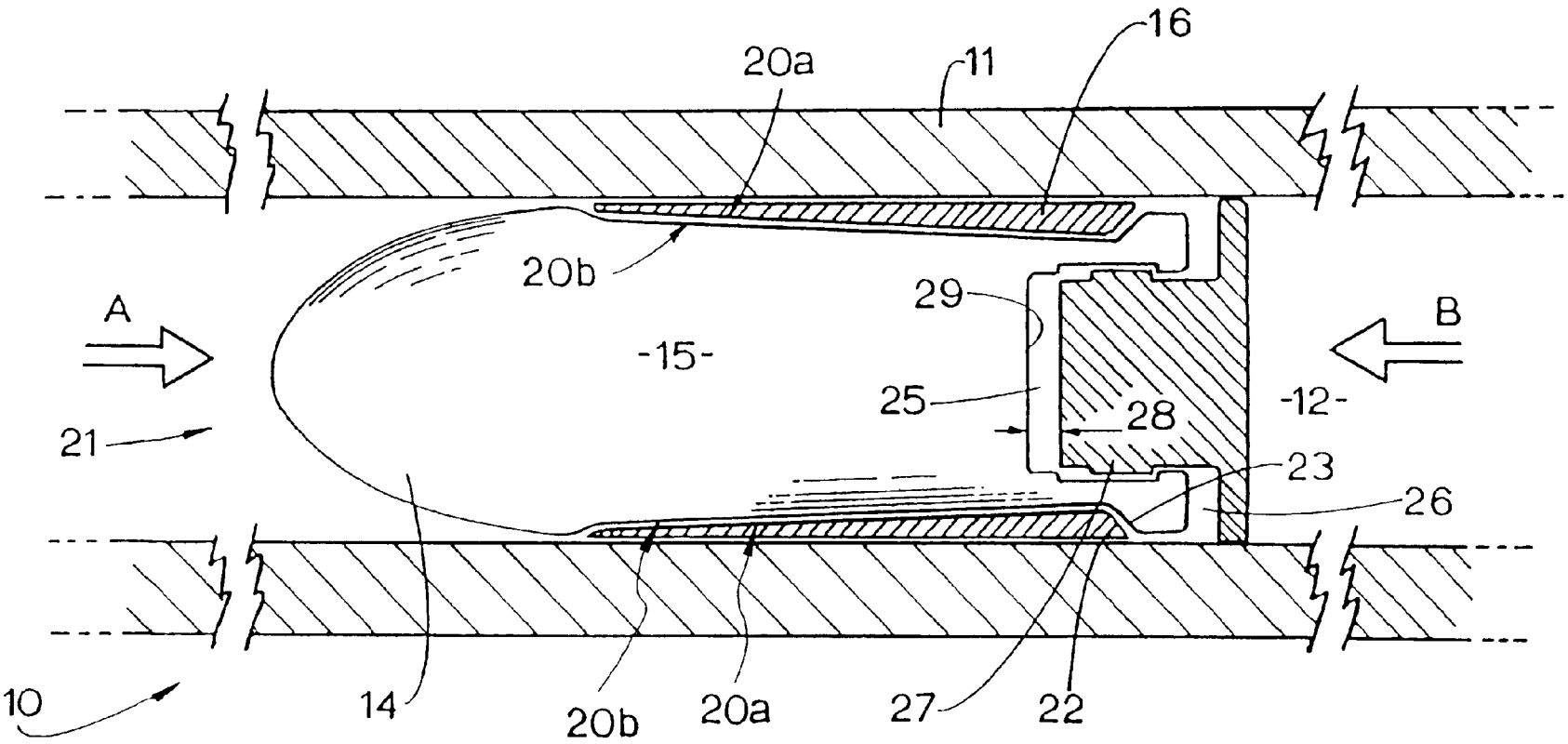

30
31
33
35
34
38
40
32
41
36
37

FIREARMS

TECHNICAL FIELD

The invention relates to munitions and firearms.

This invention has particular, but not exclusive, application providing operational safety improvements to barrels of the type having a plurality of projectiles stacked axially within the barrel in sealing engagement therewith together with discrete propellant charges which are selectively ignitable for propelling the projectiles sequentially through the muzzle of the barrel and the sealing engagement between projectiles and barrel being such as to prevent rearward travel of the ignited propellant charge to trailing propellant charges. Such barrels will be referred to hereinafter as of the type described.

BACKGROUND ART

This invention has particular application to munitions and firearms inventions as described in my earlier International Patent Applications Nos. PCT/AU94/00124 and PCT/AU96/00459 which describe a wedging action between the sealing portion and an anvil portion of a projectile which effects a seal to prevent the products of combustion of the propellant charge for a leading projectile leaking to the next adjacent unfired propellant charge and igniting same.

During testing of prototypes made according to the above-mentioned inventions concern has been raised regarding the possibility of a malfunction occurring such as a misfiring or a "hang fire" or like. While no jamming of projectiles has been experienced it is considered that this possibility needs to be minimised. The present system operates at about 40,000 psi chamber pressure but higher pressures in the order of 60,000 psi plus may be utilised.

It is envisaged that a misfire may occur either by a projectile jamming in the barrel or by the propellant for a trailing projectile being ignited prior to the propellant associated with a leading projectile.

This invention seeks to eliminate or alleviate misfiring and/or to alleviate any serious consequences in the event of a misfire occurring.

DISCLOSURE OF INVENTION

With the foregoing in view, this invention in one aspect resides broadly in a method of minimising misfiring or alleviating their consequences in a barrel of the type described including:

- forming at least each trailing projectile with a sealing portion extending about a tapered anvil portion and moveable therealong for expansion into sealing engagement with the barrel bore, and
- providing disengagement means for operatively disengaging the sealing portion from the anvil portion in response to ignition of the propellant charge associated with the projectile.

The method may be suited only to trailing projectiles to provide a forward bypass path for ignited propellant for alleviating the effect of a hang fire. Alternatively the method may be applied to each projectile including the leading projectile to enable effective discharge of projectiles loaded with high barrel engaging forces.

In the case of application of the method to trailing projectiles only, the disengagement means may be constituted by an anvil extension in the form of a spine placing the trailing anvil in columnar relationship with the adjacent leading projectile thereby increasing the resistance to forward movement of the tailing anvil portion and enabling the sealing portion to move forward along the anvil portion for operative disengagement therefrom.

The disengagement permits products of combustion of the trailing propellant charge to pass beyond the sealing portion to the leading propellant charge so as to ignite same and cause the leading projectile to be fired to free the barrel path for the trailing projectile. This may occur as a very quick chain-like reaction causing all projectiles ahead of the misfired propellant charge to be discharged.

For this purpose the sealing portion and the anvil portion of the trailing projectile or projectiles are of such form that the increased resistance to movement of a combined leading projectile and trailing projectile, upon ignition of the trailing projectile's propellant charge, permits the trailing sealing portion to accelerate more quickly than the trailing anvil portion to create a bleed passage about or through the trailing sealing portion for combustion gases to pass therethrough and ignite the leading propellant charge.

The extension of the anvil portions may be rear or front extensions or both, with the extension being in continuous abutting relationship throughout the barrel to form a compression resistant column positively locating the respective anvil portions in the barrel.

Maximum chamber pressure will be reached prior to commencement of the bleed past the sealing portion. As a result the sealing portion of the trailing projectile will be forced forward until the combustion products bleed towards the leading projectile. Because of the slight time delay that occurs between the ignition of the propellant of the following projectile and the subsequent sympathetic ignition of the propellant of the leading projectile, it is unlikely that the resultant chamber pressure will exceed a reasonable allowable maximum.

The result should be that both projectiles will leave the barrel normally except that the sealing portion of the trailing projectile may separate from its anvil. Preferably the sealing portion is in the form of a malleable nose part slidable along a centrally located anvil extension and having a conical cavity extending in from an open rear end and in which the conical shaped anvil portion is located.

Alternatively in the case of application of the method to trailing projectiles only, the disengagement means may be constituted by a pressure sensitive leverage system connected between the anvil portion and the sealing portion which is normally inoperative so as not to affect the operation of the projectile but which operates when pressures in the barrel behind the projectile increases beyond a safe operating pressure to lever the sealing portion along the anvil portion to a disengaged position.

The pressure sensitive leverage system may be used with projectiles having forward or rearward diverging wedge surfaces between the anvil portion and the sealing portion. Suitably the pressure sensitive leverage system includes an actuator mounted on the rear end face of the projectile and preferably it is in the form of a collapsible plate which normally bears against the end face for firing in abutting relationship thereto but which upon being subject to extreme pressures distorts to provide movement to actuate the leverage system.

In the case of application of the method to a leading and/or trailing projectiles, the disengagement means may be constituted by a hammer member supported for free forward movement into a cavity formed in the exposed rear end of the anvil portion such that the hammer member is driven forward upon ignition of the associated propellant charge to impart its energy to the anvil portion by impact so as to jolt the anvil portion from operative sealing engagement with the sealing portion.

The effect of this will be to assist in instantly freeing the anvil portion to minimise any chance of jamming of the projectile previously wedged in the barrel. Furthermore in the case of a trailing projectile the freeing of the anvil portion from the sealing portion will provide a bleed passage as previously described for ignition in a trailing projectile to pass forwards and ignite the propellant charge of a remaining leading projectile.

It is preferred that the leading or each projectile include a tapered sealing portion in the form of a malleable band extending about a complementary tapered anvil portion such that forward movement of the anvil portion relative to the sealing portion operatively disengages the anvil portion therefrom.

The hammer member may constitute a major or minor portion of the projectile either by bulk or weight. Preferably the cavity in which the hammer member is supported is a blind cavity formed such that in operation, the hammer strikes the end wall of the blind cavity. However, if desired the cavity may extend forwardly through the projectile and various forms of obstructions may be used to impede movement of the hammer through the cavity. The obstructions may be a forward narrowing of the cavity or abutments protruding in from the wall of the cavity.

In one form the hammer is a relatively large diameter cylindrical body sealably and slidably supported in a correspondingly shaped cavity and moveable to a home or impacted position against the end wall of the cavity and at which the cavity is substantially filled by the hammer.

The hammer may be formed from the same material as the anvil portion or it may be formed from a different material such as a material having a different density or a different malleability, the particular combination of physical sizes, configurations and characteristics being selected to suit the purpose of the projectile.

In another aspect this invention resides broadly in a barrel of the type described, wherein:

each trailing projectile has a sealing portion extending about a tapered anvil portion and arranged in sealing engagement with the barrel bore and moveable forwardly therealong for operative freeing from the anvil portion;

a spine extends from each anvil portion placing the anvil anvil portions in columnar relationship with the barrel, and the rear part of each sealing projectile is exposed too their respective propellant charges for forward propulsion relative to the anvil portion about which they extend when forward movement of such anvil portions is resisted.

In a further aspect this invention resides broadly in a barrel of the type described, wherein:

each projectile includes a sealing portion extending about a tapered anvil portion and loaded into the barrel with high barrel engaging forces by relative forward movement of the sealing portion along the anvil portion;

each projectile includes a hammer member supported for free forward movement into a cavity formed in the exposed rear end of the anvil portion, and each hammer member being exposed, in use, to its ignited propellant for forward acceleration to impart its energy to the anvil portion by impact so as to jolt the anvil portion from operative sealing engagement with the sealing portion.

In yet a further aspect this invention resides broadly in a barrel of the type described, wherein:

each projectile includes a sealing portion extending about a tapered anvil portion and loaded into the barrel by relative forward movement of the sealing portion along the anvil portion;

each projectile includes a pressure sensitive leverage system connected between the anvil portion and the sealing portion which operates when pressures in the barrel behind the projectile increases beyond a safe operating pressure to lever the sealing portion rearwardly along the anvil portion to a disengaged position.

DESCRIPTION OF THE PREFERRED EMBODIMENTS

Figures 2A, 2B, 2C:
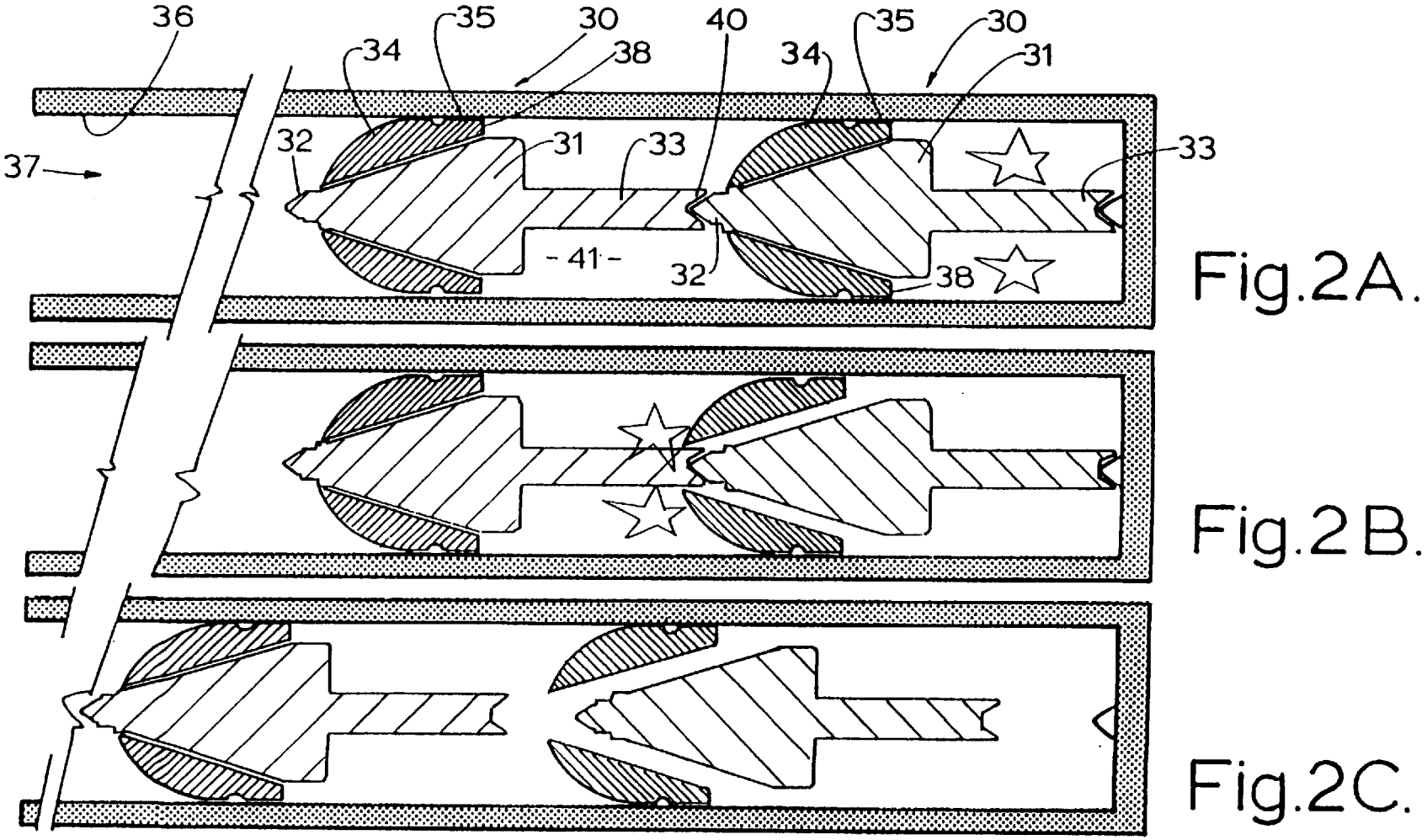
Figures 3A, 3B:
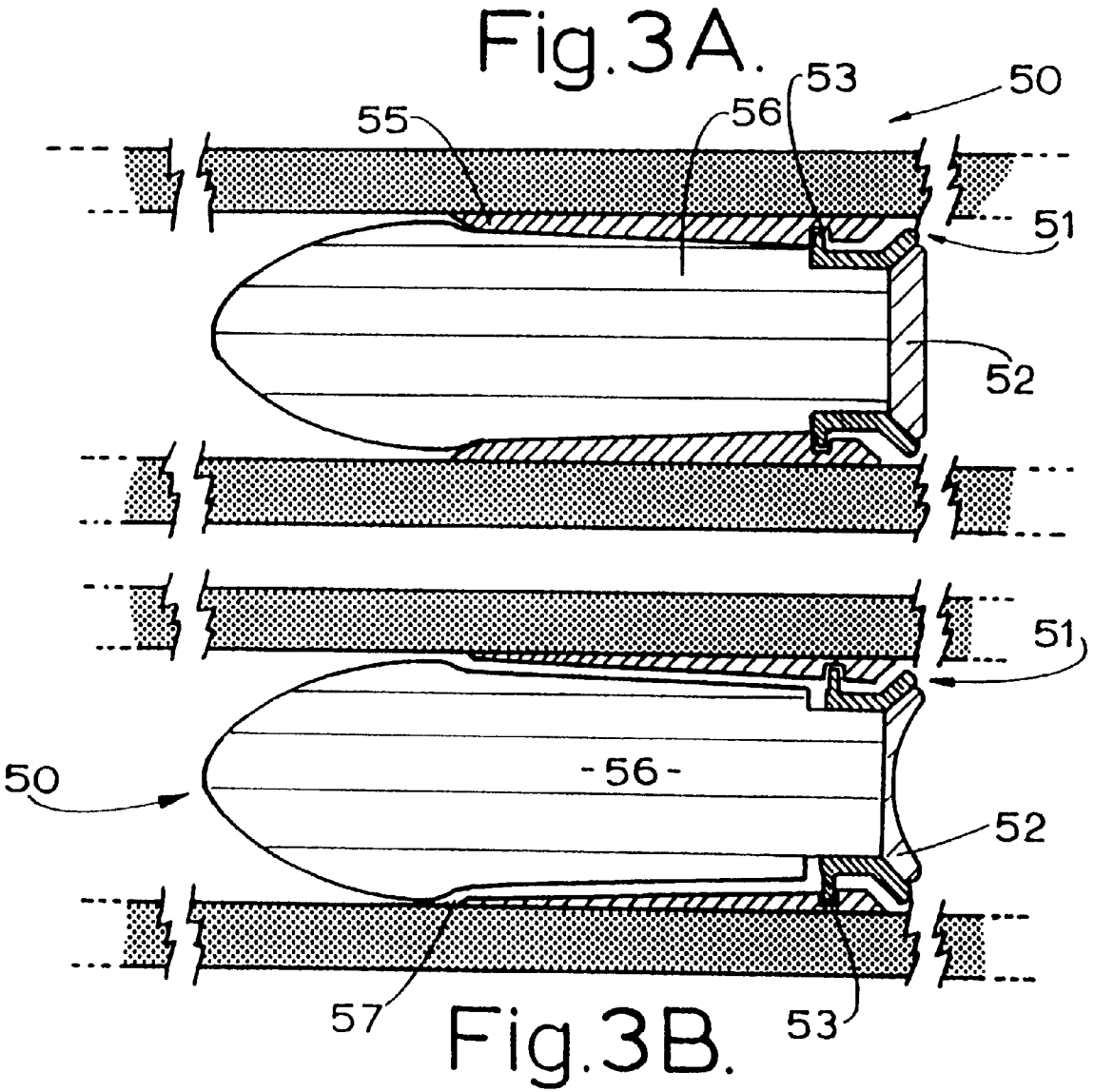

In order that this invention may be more readily understood and put into practical effect, reference will now be made to the accompanying drawings which illustrate typical embodiments of the invention, wherein:

FIG. 1 is a diagrammatic cut-away view of a typical hammer freed projectile according to one aspect of this invention;

FIGS. 2A to 2C diagrammatically illustrate the results of a hang fire in a trailing round, and FIGS. 3A and 3B illustrate the sequence of operations of a further embodiment of the invention.

According to the embodiment illustrated in FIG. 1, each projectile assembly 10 in a barrel of the type described is supported in a barrel 11 together with propellant in the trailing space 12 immediately behind the projectile assembly 10.

Each projectile assembly 10 includes a generally bullet shaped anvil part 14 having a waisted body portion 15 which tapers inwardly slightly towards its trailing end. A complementary tapered sealing band 16 is supported on the waisted body portion 15. The band has free travel space at each end of the waisted body portion 15 such that it may move to and fro to engage and operative disengage therefrom.

When loading, impact applied to the projectile 14, provided in the direction 'A' when the projectile is located at the appropriate location within the barrel 11, will cause the complementary wedging surfaces 20*a* and 20*b* to engage and expand the sealing band 16 outwardly into firm sealing engagement with the bore 21 of the barrel 11, sealing and locating the projectile assembly 10 in place in the barrel 11.

This seal prevents the ignited propellant charge from bypassing the adjacent trailing projectile and igniting its propellant charge, but permits the complementary wedging surfaces 20*a* and 20*b* to disengage upon relative forward movement of the anvil part 14.

The trailing face 22 of the sealing band 16 is oppositely tapered to its inner face 20*a* and at a relatively sharp angle and it is spaced from the correspondingly tapered rear return face 23 of the waisted body portion 15. When the faces 22 and 23 are operatively engage at the commencement of forward movement of the anvil part 14 as it is propelled through the barrel 11 so as to carry the sealing band 16 with the projectile through the barrel and in effective sealing engagement therewith.

In this embodiment, a relatively large diameter blind cylindrical cavity 25 is provided centrally in the rear face 26 of the projectile 14 and a corresponding shaped hammer 27 is slidably engaged within the recess 25. The hammer 27 is substantially the same size as the recess 25 so that the recess 25 is filled when the hammer is fully inserted thereto.

However, when loaded the hammer 27 is maintained slightly proud of the rear face 26 so that a gap 28 is provided in front of the hammer 27 into which it may travel in direction B upon ignition of the propellant charge in the space 12.

In this embodiment the hammer 27 is made of a relatively rigid material such as steel and the initial pressure within the barrel 11 resulting from ignition of the propellant charge will drive the hammer 27 forwardly until it contacts the blind end 29 of the cavity or recesses 25 providing an impact to free the wedging surfaces 20*a* and 20*b* from one another and thus unlock the projectile assembly 10 from the barrel 11. Thereafter the pressure within the barrel will act on the combined rear face of the hammer 27 and the projectile 14 to propel the projectile assembly 10 from the barrel 11.

It is considered that the impact or jolting provided by initial movement of the hammer 27 will ensure that release of the locked wedging surfaces 20*a* and 20*b* will occur instantaneously and ensure effective propulsion of the projectile assembly from the barrel.

It is also considered that this arrangement will be particularly advantageous where high in-barrel pressures such as in the order of 60,000 psi or more are utilised to propel the projectiles and/or where relatively large impact forces in the direction 'A' are utilised to lock the projectile assembly 14 in place in the barrel 11.

In the case of a hang fire in a trailing round the operative release of the locked wedging surfaces 20*a* and 20*b* will permit sufficient bypass of propellant gases to ignite the propellant of the leading round.

In the embodiment illustrated in FIGS. 2A through 2C and referring initially to FIG. 2A, it will be seen that each projectile assembly 30 includes a conical anvil portion 31 formed with axial extension columns 32 and 33 extending from the leading and trailing ends, respectively, thereof. An annular nose part 34, formed of malleable material, extends about the leading column portion 32 and rearwardly about the anvil portion 31 forming an internally tapered sealing ring 35 which may be forced outwardly into sealing engagement with the bore 36 of the barrel 37 by relative rearward movement thereof along the anvil portion 31. This effects an operative seal as previously described to prevent rearward bypass of high pressure ignited propellant gases. Both the rear end 38 of the sealing ring 35 and the anvil portion 31 are exposed to the propellant charge.

It will be seen that the leading and trailing extension columns 32 and 33 form a compression resistant column throughout the barrel 37 and are of the same diameter so that the annular nose part 34 may move forward past the column join at 40.

Under normal circumstances ignition of the leading propellant charge 41 will dislodge the leading projectile and force it out through the muzzle at high velocity. In the event of a hang fire occurring in a trailing round, such as is illustrated in FIGS. 2Ba and 2C, the resistance to forward movement of the trailing anvil portion 31 increases as it must also move the leading projectile through the abutting columns 32 and 33.

A lesser resistance to forward movement of the nose part 34 enables it to move forward slightly along the anvil portion 31 so that propellant gases will bleed forwardly and ignite the leading propellant charge 41 causing the both projectiles to be accelerated through the muzzle as described above.

In the embodiment illustrated in FIGS. 3A and 3B and referring initially to FIG. 3A, it will be seen that the sealing arrangement of each projectile assembly 50 is of the same form as illustrated in FIG. 1. However, in this embodiment, a leverage system, illustrated diagrammatically at 51, extends from a deformable end cap 52 to engage in a recess 53 provided on the inside of the sealing band 55. During normal firing, the projectile will behave normally and exit the muzzle in the form illustrated in FIG. 3A.

In the case of a hang fire the end cap 52 is formed so as to collapse in the middle as a consequence of the high in-barrel pressures created by the hang fire. This distortion of the end cap is relayed to the periphery of the end cap causing the periphery to curve rearwardly, pulling the levers 51 rearwardly and thus freeing the sealing band 55 from the tapered waisted portion 56 to provide a bypass passage 57 for ignited propellant as described above.

It will of course be realised that the above has been given only by way of illustrative example of the invention and that all such modifications and variations thereto as would be apparent to persons skilled in the art are deemed to fall within the broad scope and ambit of the invention as is defined in the appended claims.

What is claimed is:

1. A method of firing a projectile from a barrel assembly, wherein the barrel assembly includes a barrel, a plurality of projectiles axially disposed within the barrel for operative sealing engagement with a bore of the barrel, and discrete propellant charges for propelling respective ones of the plurality of projectiles sequentially through a muzzle of the barrel, each of the plurality of projectiles includes a sealing portion extending about a tapered anvil portion for sealing engagement with the bore of the barrel upon the projectile being inserted into the barrel before firing, and moveable relative to the tapered anvil portion for operative freeing from the tapered anvil portion, said method comprising the steps of:

detonating respective ones of the propellant charges, whereby a detonation of any one of the propellant charges urges a disengagement means to operatively disengage the sealing portion from the tapered anvil portion, and wherein the disengagement means is formed from a pressure sensitive lever connected between the tapered anvil portion and the sealing portion of each projectile of the plurality of projectiles, whereby the step of detonating of each propellant charge of the discrete propellant charges of each projectile of the plurality of projectiles causes the sealing portion to be levered relative the tapered anvil portion so as to free each projectile of the plurality of projectiles from operative sealing engagement with the bore of the barrel.

2. The method as claimed in claim 1, wherein the sealing portion of each projectile of the plurality of projectiles is a malleable band such that rearward movement of the sealing portion relative to the tapered anvil portion operatively disengages each projectile of the plurality of projectiles from the bore of the barrel.

3. A method of firing a projectile from a barrel assembly, wherein the barrel assembly includes a barrel, a plurality of projectiles axially disposed within the barrel for operative sealing engagement with a bore of the barrel, and discrete propellant charges for propelling respective ones of the plurality of projectiles sequentially through a muzzle of the barrel, each of the plurality of projectiles includes a sealing portion extending about a tapered anvil portion for sealing engagement with the bore of the barrel upon the projectile being inserted into the barrel before fling, and moveable relative to the tapered anvil portion for operative freeing from the tapered anvil portion, said method including the steps of:

detonating respective ones of the propellant charges, whereby a detonation of any one of the propellant charges urges a disengagement means to operatively disengage the sealing portion from the tapered anvil portion, and wherein the disengagement means is a hammer member supported for free forward movement into a cavity formed in the tapered anvil portion, the hammer member being exposed to each propellant charge of the propellant charges, whereby the, step of detonating of each propellant charge of the propellant charges accelerates the hammer member so as to impart impact energy on the tapered anvil portion so as to jolt each projectile, of said plurality of projectiles free of operative sealing engagement with the bore of the barrel.

4. The method as claimed in claim 3, wherein the sealing portion of each projectile of the plurality of projectiles is a malleable band extending about the tapered anvil portion such that rearward movement of the sealing portion relative to the tapered anvil portion operatively disengages each projectile of the plurality of projectiles from the bore of the barrel.

5. The method as claimed in claim 3, wherein the cavity in the tapered anvil portion in which the hammer member is supported is a blind cavity.

6. A barrel assembly comprising:

a barrel;

a plurality of projectiles axially disposed within the barrel for operative sealing engagement with the bore of the barrel; and discrete propellant charges for propelling respective projectiles sequentially through the muzzle of the barrel;

wherein each projectile of the plurality of projectiles includes:

a tapered anvil portion;

a sealing portion extending about the tapered anvil portion for sealing engagement with the bore of the barrel upon the projectile being inserted into the barrel before firing, the sealing portion being rearwardly moveable relative to the tapered anvil portion for operative freeing from the tapered anvil portion; and a hammer member supported for free forward movement into a cavity formed in the tapered anvil portion, wherein the hammer member is exposed to a respective propellant charge of the plurality of propellant charges such that, in use, a detonation of the respective propellant charge of the plurality of propellant charges accelerates the hammer member to impart impact energy to the tapered anvil portion so as to jolt a respective projectile of the plurality of projectiles free from operative sealing engagement with the bore of the barrel.

7. The method as claimed in claim 6, wherein the sealing portion of each projectile of the plurality of projectiles is a malleable band extending about the tapered anvil portion such that rearward movement of the sealing portion relative to the tapered anvil portion operatively disengages each projectile of the plurality of projectiles from the bore of the barrel.

8. The barrel assembly as claimed in claim 6, wherein the cavity in the tapered anvil portion in which the hammer member is supported is a blind cavity.

9. A barrel assembly comprising:

a barrel;

a plurality of projectiles axially disposed within the barrel for operative sealing engagement with a bore of the barrel, and a plurality of discrete propellant charges for propelling each projectile of the plurality of projectiles sequentially through a muzzle of the barrel, wherein each projectile of the projectiles includes:

a tapered anvil portion;

a sealing portion extending about the tapered anvil portion for sealing engagement with the bore of the barrel upon the projectile being inserted into the barrel before firing, the sealing portion being rearwardly moveable relative to the tapered anvil portion for operative freeing from the tapered anvil portion; and a pressure sensitive lever connected between the tapered anvil portion and the sealing portion, whereby, in use, detonation of each propellant charge of the plurality of discrete propellant charges causes the sealing portion to be levered relative to the tapered anvil portion so as to free each projectile of the plurality of projectiles from operative sealing engagement with the bore of the barrel.

10. The barrel assembly as claimed in claim 9, wherein the sealing portion of each projectile of the plurality of projectiles is a malleable band extending about the tapered anvil portion such that rearward movement of the sealing portion relative to the tapered anvil portion operatively disengages each projectile of the plurality of projectiles from the bore of the barrel.

* * * * *